US008469759B2

(12) United States Patent
Hori et al.

(10) Patent No.: US 8,469,759 B2
(45) Date of Patent: Jun. 25, 2013

(54) METHOD OF MANUFACTURING SPARK PLUG

(75) Inventors: Yasuhiro Hori, Kasugai (JP); Ryuji Emoto, Ohbu (JP)

(73) Assignee: NGK Spark Plug Co., Ltd, Nagoya (JP)

( * ) Notice: Subject to any disclaimer, the term of this patent is extended or adjusted under 35 U.S.C. 154(b) by 0 days.

(21) Appl. No.: 13/433,443

(22) Filed: Mar. 29, 2012

(65) Prior Publication Data

US 2012/0252298 A1 Oct. 4, 2012

(30) Foreign Application Priority Data

Apr. 1, 2011 (JP) ..... 2011-81521

(51) Int. Cl.
*H01T 21/02* (2006.01)

(52) U.S. Cl.
USPC ..... 445/7; 313/141; 313/118

(58) Field of Classification Search
USPC ..... 313/118, 141; 445/7
See application file for complete search history.

(56) References Cited

U.S. PATENT DOCUMENTS 6,595,818 B2 7/2003 Uehara
8,344,604 B2 1/2013 Torii et al.
2002/0092835 A1 7/2002 Uehara
2002/0105254 A1* 8/2002 Hori et al. ..... 313/141
2005/0077807 A1* 4/2005 Suzuki et al. ..... 313/141
2010/0242888 A1 9/2010 Torii et al.
2010/0264802 A1* 10/2010 Tanaka et al. ..... 313/141

FOREIGN PATENT DOCUMENTS

JP 2002-216930 A 8/2002
JP 2005-203121 A 7/2005
JP 2009-163923 A 7/2009
WO WO-2009/063930 A1 5/2009

OTHER PUBLICATIONS

Office Action mailed Apr. 9, 2013 for the corresponding Japanese Patent Application No. 2011-81521.

* cited by examiner

*Primary Examiner* — Mary Ellen Bowman
(74) *Attorney, Agent, or Firm* — Leason Ellis LLP.

(57) ABSTRACT

In joining a composite tip to an electrode, a method is used for properly adjusting the height of radiation of a laser beam to the height of the boundary between two tips used to form the composite tip. Further, a process for joining a first tip and a second tip together by use of a laser beam includes the steps of; (a) disposing the second tip on a support; (b) obtaining, after pressing downward at least the second tip by the use of a pressing jig, a correction value for correcting the height of radiation of a laser beam; (c) correcting the height of radiation of the laser beam on the basis of the correction value; and (d) joining the first and second tips together by use of the laser beam.

5 Claims, 9 Drawing Sheets

PLACE SECOND TIP 60 ON SUPPORT

MEASURE TOP-FACE HEIGHT OF SECOND TIP 60 BY IMAGE PROCESSING

PLACE FIRST TIP 70 ON SECOND TIP 60

TOP-PRESS FIRST TIP 70 AND MEASURE WITH LENGTH-MEASURING SENSOR

PLACE SECOND TIP 60 ON SUPPORT

MEASURE TOP-FACE HEIGHT OF SECOND TIP 60 BY IMAGE PROCESSING

PLACE FIRST TIP 70 ON SECOND TIP 60

TOP-PRESS FIRST TIP 70 AND MEASURE WITH LENGTH-MEASURING SENSOR

CORRECT TOP-FACE HEIGHT OF SECOND TIP 60 AND WELD FIRST AND SECOND TIPS

PLACE SECOND TIP 60 ON SUPPORT

MEASURE TOP-FACE HEIGHT OF SECOND TIP 60 BY IMAGE PROCESSING

TOP-PRESS SECOND TIP 60

REMEASURE TOP-FACE HEIGHT OF SECOND TIP 60 BY IMAGE PROCESSING

CORRECT TOP-FACE HEIGHT OF SECOND TIP 60 AND WELD FIRST AND SECOND TIPS

PLACE SECOND TIP 60 ON SUPPORT

MEASURE TOP-FACE HEIGHT OF SECOND TIP 60 BY IMAGE PROCESSING

PLACE FIRST TIP 70 ON SECOND TIP 60

TOP-PRESS FIRST TIP 70 AND REMEASURE BY IMAGE PROCESSING

CORRECT TOP-FACE HEIGHT OF SECOND TIP 60 AND WELD FIRST AND SECOND TIPS

METHOD OF MANUFACTURING SPARK PLUG

CROSS-REFERENCE TO RELATED PATENT APPLICATIONS

This application claims the benefit of Japanese Patent Application No. 2011-81521, filed Apr. 1, 2011, which is incorporated by reference herein.

FIELD OF THE INVENTION

The present invention relates to a method of manufacturing a spark plug.

BACKGROUND OF THE INVENTION

Conventionally, there has been used a spark plug in which noble metal tips are provided on ends of respective electrodes. A method of manufacturing such a spark plug usually employs a step of forming a composite tip by joining a noble metal tip and an intermediate tip (e.g., an Ni tip) together, and joining the intermediate tip of the composite tip to an end of an electrode.

However, since the noble metal tip and the intermediate tip are such small members that their diameters and heights are about 1 mm, in formation of a composite tip by laser-welding them together, it is not necessarily easy to properly align the height of radiation of a laser beam with the height of the boundary between the two tips. Notably, such a problem is not a problem which occurs only in a process of joining a noble metal tip and an intermediate tip together, but is a common problem which occurs in general cases where two tips are joined together.

PRIOR ART DOCUMENT

[Patent Document 1] Japanese Patent Application Laid-Open (kokai) No. 2009-163923

SUMMARY OF THE INVENTION

An object of the present invention is to provide a technique for, in joining a composite tip to an electrode, properly adjusting the height of radiation of a laser beam to the height of the boundary between two tips used to form the composite tip.

In order to solve, at least partially, the above problem, the present invention can be embodied in the following modes or application examples.

APPLICATION EXAMPLE 1

Application example 1 is a method of manufacturing a spark plug which comprises a center electrode; an insulator disposed externally of an outer circumference of the center electrode; a metallic shell disposed externally of an outer circumference of the insulator; and a ground electrode joined at one end portion to the metallic shell and disposed such that the other end portion faces the center electrode. At least one of the center electrode and the ground electrode has a composite tip. The composite tip is configured such that a first tip and a second tip are joined together. The first tip forms a gap in cooperation with the center electrode or the ground electrode. The second tip connects the first tip to the center electrode or the ground electrode. The method comprises a joining process for joining the first tip and the second tip together by use of a laser beam. The joining process comprises (a) a step of disposing the second tip on a support; (b) a step of obtaining, after pressing downward at least the second tip by use of a pressing jig, a correction value for correcting a height of radiation of the laser beam; (c) a step of correcting the height of radiation of the laser beam on the basis of the correction value; and (d) a step of joining the first and second tips together by use of the laser beam.

According to the present configuration, after at least the second tip is pressed downward by use of the pressing jig, a correction value is obtained for correcting the height of radiation of a laser beam; then, the height of radiation of the laser beam is corrected on the basis of the correction value. Therefore, the height of radiation of the laser beam can be properly adjusted to the height of the boundary between the two tips used to form the composite tip.

APPLICATION EXAMPLE 2

In the method of manufacturing a spark plug according to application example 1, the joining process further comprises a step (i) which is performed before the step (b) so as to obtain information representing a top-face height of the second tip supported on the support by use of a first measuring unit; and the step (b) comprises a step of disposing the first tip on the second tip; a first-tip top pressing step of pressing downward a top face of the first tip by use of the pressing jig; a step of obtaining, after the first-tip top pressing step, information representing a top-face height of the first tip by use of a second measuring unit; and a step of obtaining the correction value by use of the obtained information representing the top-face height of the first tip, the information representing the top-face height of the second tip, which is obtained in the step (i), and a predetermined reference top-face height.

According to the present configuration, a desirable correction value can be obtained by use of the measured top-face height information about the first and second tips and the predetermined reference top-face height.

APPLICATION EXAMPLE 3

In the method of manufacturing a spark plug according to application example 2, the first measuring unit captures an image of the second tip and analyzes the image to obtain the information representing the top-face height of the second tip, and the second measuring unit obtains the information representing the top-face height of the first tip according to a measuring principle different from that of the first measuring unit.

According to the present configuration, the top-face heights of the tips are measured by use of two measuring units different in measuring principle; therefore, measurement can be performed under measuring conditions suited for respective measuring principles and measuring unit configurations.

APPLICATION EXAMPLE 4

In the method of manufacturing a spark plug according to application example 3, the second measuring unit is a length-measuring sensor.

Since the present configuration utilizes the length-measuring sensor, the top-face height information about the first tip placed on the second tip can be readily obtained.

APPLICATION EXAMPLE 5

In the method of manufacturing a spark plug according to application example 1, the joining process further comprises a step (i) which is performed before the step (b) so as to obtain information representing a top-face height of the second tip supported on the support by use of a first measuring unit; the step (b) comprises a step of reobtaining, after pressing downward the second tip by use of the pressing jig, information representing a top-face height of the second tip by use of the first measuring unit, and a step of obtaining the correction value by use of the reobtained information representing the top-face height of the second tip and the information representing the top-face height of the second tip obtained in the step (i); and the joining process further comprises a step of disposing the first tip on the second tip before the step (d) of joining the first and second tips together.

According to the present configuration, after the second tip is pressed downward by use of the pressing jig, the top-face height information about the second tip is reobtained and the correction value is obtained by use of the reobtained top-face height information and the previously obtained top-face height information, whereby a desirable correction value can be readily obtained.

The present invention can be embodied in various forms. For example, the present invention can be embodied in a spark plug, a metal member for use in a spark plug, and a method of manufacturing a spark plug and such a metal member.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Modes for Carrying Out the Invention

A. First Embodiment

Figure 1:
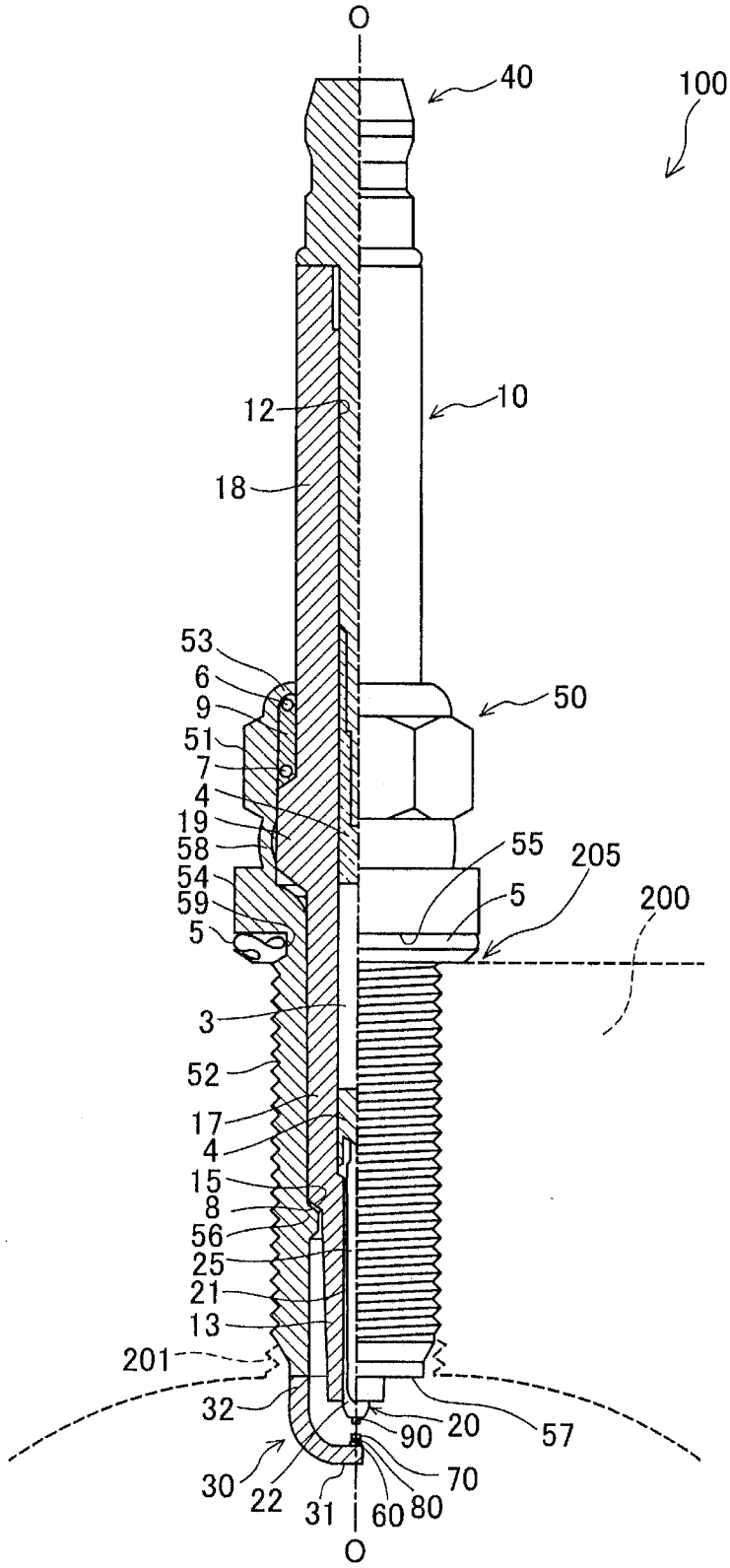
FIG. 1 is a partially sectional view showing a spark plug according to an embodiment of the present invention.

FIG. 1 is a partially sectional view showing a spark plug 100 according to an embodiment of the present invention. In the following description, the direction of an axis O of the spark plug 100 in FIG. 1 is referred to as the vertical direction, and the lower side of the spark plug 100 in FIG. 1 is referred to as the forward side of the spark plug 100, and the upper side as the rear side. The spark plug 100 includes an insulator 10, a metallic shell 50, a center electrode 20, a ground electrode 30, and a metal terminal 40.

The insulator 10 is formed from alumina or the like through firing and has a tubular shape such that an axial bore 12 extends therethrough coaxially along the direction of the axis O. The insulator 10 is adapted to electrically insulate the center electrode 20 and the metallic shell 50 from each other. The insulator 10 has a flange portion 19 having the largest outside diameter and located substantially at the center with respect to the direction of the axis O, and a rear trunk portion 18 located rearward (upward in FIG. 1) of the flange portion 19. The insulator 10 also has a forward trunk portion 17 smaller in outside diameter than the rear trunk portion 18 and located forward (downward in FIG. 1) of the flange portion 19, and a leg portion 13 smaller in outside diameter than the forward trunk portion 17 and located forward of the forward trunk portion 17. The leg portion 13 is reduced in diameter in the forward direction and is exposed to a combustion chamber of an internal combustion engine when the spark plug 100 is mounted to an engine head 200 of the engine. The insulator 10 further has a stepped portion 15 formed between the leg portion 13 and the forward trunk portion 17.

The center electrode 20 is a rodlike electrode which is held in the insulator 10 along the direction of the axis O. The center electrode 20 has a structure in which a core 25 is embedded within an electrode base metal 21. The electrode base metal 21 is formed of nickel or an alloy which contains nickel as a main component, such as INCONEL (trade name) 600 or 601. The core 25 is formed of copper or an alloy which contains copper as a main component, copper and the alloy being superior in thermal conductivity to the electrode base metal 21. Usually, the center electrode 20 is fabricated as follows: the core 25 is disposed within the electrode base metal 21 which is formed into a closed-bottomed tubular shape, and the resultant assembly is drawn by extrusion from the bottom side. The core 25 is formed such that, while a trunk portion has a substantially fixed outside diameter, a forward end portion is tapered.

A distal end portion 22 of the center electrode 20 projects from the forward end of the insulator 10 and tapers forward. A noble metal tip 90 is joined to the forward end surface of the distal end portion 22 of the center electrode 20. The noble metal tip 90 has a substantially circular columnar shape and is formed of a noble metal having high melting point in order to improve resistance to spark-induced erosion. The noble metal tip 90 can be formed of, for example, iridium (Ir) or an Ir alloy which contains Ir as a main component and an additive of one or more elements of platinum (Pt), rhodium (Rh), ruthenium (Ru), palladium (Pd), rhenium (Re), etc.

The center electrode 20 and the noble metal tip 90 are joined together by full-circle laser welding with a laser beam radiated to the boundary between the noble metal tip 90 and the distal end portion 22 of the center electrode 20. In laser welding, since the two materials irradiated with a laser beam are fused and mixed, the noble metal tip 90 and the center electrode 20 are firmly joined together. The center electrode 20 extends rearward within the axial bore 12 and is electrically connected to the rear (upper in FIG. 1) metal terminal 40 via a seal body 4 and a ceramic resistor 3. A high-voltage cable (not shown) is connected to the metal terminal 40, which is provided at the rear end of the insulator 10, via a plug cap (not shown) for applying high voltage to the metal terminal 40.

The ground electrode 30 is welded at its proximal portion 32 to a forward end surface 57 of the metallic shell 50 and is disposed such that one side surface of its distal end portion 31 faces the distal end portion 22 of the center electrode 20. The ground electrode 30 is formed of a metal having high corrosion resistance; for example, a nickel alloy, such as INCONEL (trade name) 600 or 601. The ground electrode 30 has a substantially rectangular cross section across its longitudinal direction. The distal end portion 31 of the ground electrode 30 is bent such that one side surface of the distal end portion 31 faces, on the axis O, the noble metal tip 90 welded to the center electrode 20.

An intermediate tip 60 is joined to a surface of the distal end portion 31 of the ground electrode 30, which surface faces the distal end portion 22 of the center electrode 20 on the axis O. The intermediate tip 60 can be formed of, for example, an Ni alloy which contains chromium (Cr), silicon (Si), manganese (Mn), aluminum (Al), etc. A noble metal tip 70 is joined to the intermediate tip 60 on a side (the upper side in the drawings) toward the distal end portion 22 of the center electrode 20. The intermediate tip 60 and the noble metal tip 70 are joined together by laser welding. As a result of fusion of the noble metal tip 70 and the intermediate tip 60, a fusion zone 80 is formed. The noble metal tip 70 can be formed of, for example, a Pt alloy which contains Pt as a main component, and one or more elements of Rh, Ni, etc. as an addi tive(s).

As will be described later, in the course of manufacture of the spark plug, a composite tip is formed by joining the intermediate tip 60 and the noble metal tip 70 together, and the composite tip is joined to the distal end portion 31 of the ground electrode 30. Notably, the noble metal tip 70 may be called the "first tip," and the intermediate tip 60 may be called the "second tip."

The metallic shell 50 is a cylindrical metallic member adapted to fix the spark plug 100 to the engine head 200 of the internal combustion engine. The metallic shell 50 holds the insulator 10 therein. The metallic shell 50 is formed of low-carbon steel and has a tool engagement portion 51, to which an unillustrated spark plug wrench is fitted, and a mounting threaded portion 52, which has threads formed thereon and is threadingly engaged with a mounting threaded hole 201 of the engine head 200 provided at an upper portion of the internal combustion engine.

The metallic shell 50 has a flange-like seal portion 54 formed between the tool engagement portion 51 and the mounting threaded portion 52. An annular gasket 5 formed by folding a sheet is fitted to a screw neck 59 between the mounting threaded portion 52 and the seal portion 54. When the spark plug 100 is mounted to the engine head 200, the gasket 5 is crushed and deformed between a seat surface 55 of the seal portion 54 and a peripheral-portion-around-opening 205 of the mounting threaded hole 201. The deformation of the gasket 5 provides a seal between the spark plug 100 and the engine head 200, thereby preventing gas leakage from inside the engine via the mounting threaded hole 201.

The metallic shell 50 has a thin-walled crimp portion 53 located rearward of the tool engagement portion 51. The metallic shell 50 also has a buckle portion 58, which is thin-walled similar to the crimp portion 53, between the seal portion 54 and the tool engagement portion 51. Annular ring members 6 and 7 intervene between the insulator 10 and an inner circumferential surface of the metallic shell 50 extending from the tool engagement portion 51 to the crimp portion 53; furthermore, a space between the two ring members 6 and 7 is filled with a powder of talc 9. When the crimp portion 53 is crimped inward, the insulator 10 is pressed forward within the metallic shell 50 via the ring members 6 and 7 and the talc 9. Accordingly, the stepped portion 15 of the insulator 10 is supported via the annular sheet packing 8 by a stepped portion 56 formed on the inner circumference of the metallic shell 50 at a position corresponding to the mounting threaded portion 52, whereby the metallic shell 50 and the insulator 10 are united together. At this time, gastightness between the metallic shell 50 and the insulator 10 is maintained by means of the annular sheet packing 8, thereby preventing outflow of combustion gas. The buckle portion 58 is designed to be deformed outwardly in association with application of compressive force in a crimping process, thereby contributing toward increasing the length of compression of the talc 9 in the direction of the axis O and thus enhancing gastightness within the metallic shell 50. A clearance having predetermined dimensions is provided between the metallic shell 50 and the insulator 10 in a forward end region.

The entire configuration of the spark plug 100 shown in FIG. 1 is a mere example. The spark plug can employ various other configurations.

Figure 2:
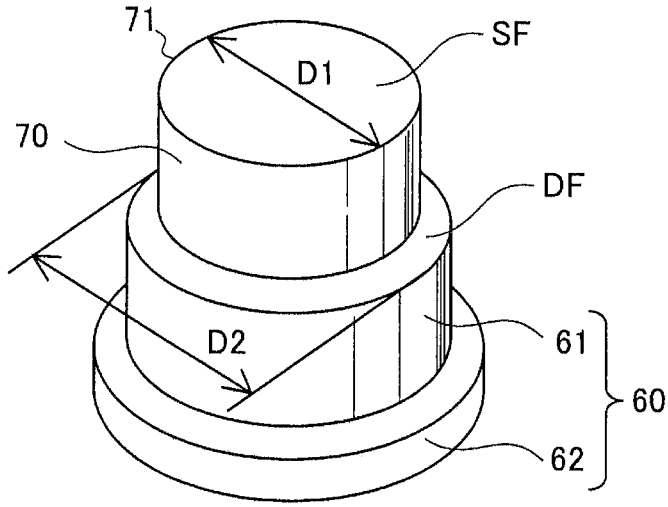
FIG. 2 is a perspective view showing a noble metal tip and an intermediate tip before joining.

FIG. 2 is a perspective view showing the noble metal tip 70 and the intermediate tip 60 before joining. The noble metal tip 70 has a substantially circular columnar shape and has a gap formation face SF (also called the "top face" or "upper bottom face") perpendicular to the axis. In the spark plug 100, the gap formation face SF is disposed in such a manner as to face the distal end portion 22 of the center electrode 20. The gap formation face SF has a substantially circular shape with its edge 71 serving as the circumference of the circle. The intermediate tip 60 has a columnar portion 61 having a substantially circular cross section and a flange portion 62 radially expanding from the columnar portion 61. The top face of the columnar portion 61 functions as a disposition face DF on which the noble metal tip 70 is disposed. The disposition face DF has an approximately circular shape. The noble metal tip 70 is disposed on the disposition face DF of the intermediate tip 60 in such a manner that the axis of the noble metal tip 70 and the axis of the intermediate tip 60 are aligned with each other. Usually, a diameter D1 of the noble metal tip 70 is slightly smaller than a diameter D2 of the displacement face DF of the intermediate tip 60.

Figure 3:
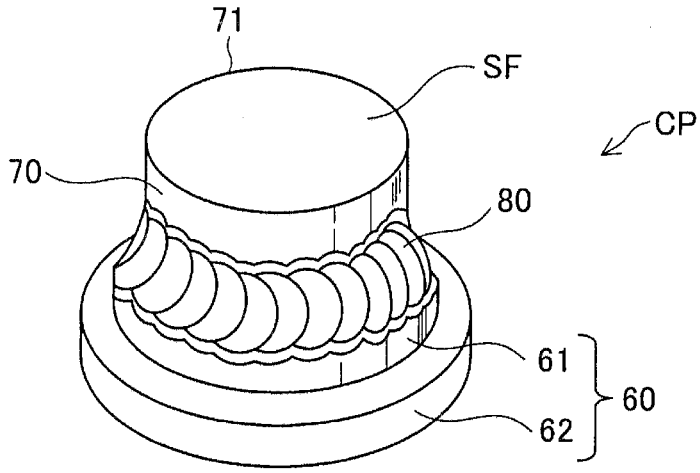
FIG. 3 is a perspective view showing a composite tip in which the noble metal tip and the intermediate tip are joined together.

FIG. 3 is a perspective view showing a composite tip CP in which the noble metal tip 70 and the intermediate tip 60 are joined together. The intermediate tip 60 and the noble metal tip 70 are joined together by laser welding or the like, yielding the composite tip CP. As a result of the welding, the fusion zone 80 is formed at the boundary between the intermediate tip 60 and the noble metal tip 70. The flange portion 62 of the composite tip CP is joined to the distal end portion 31 of the ground electrode 30 by resistance welding or the like.

Figure 4:
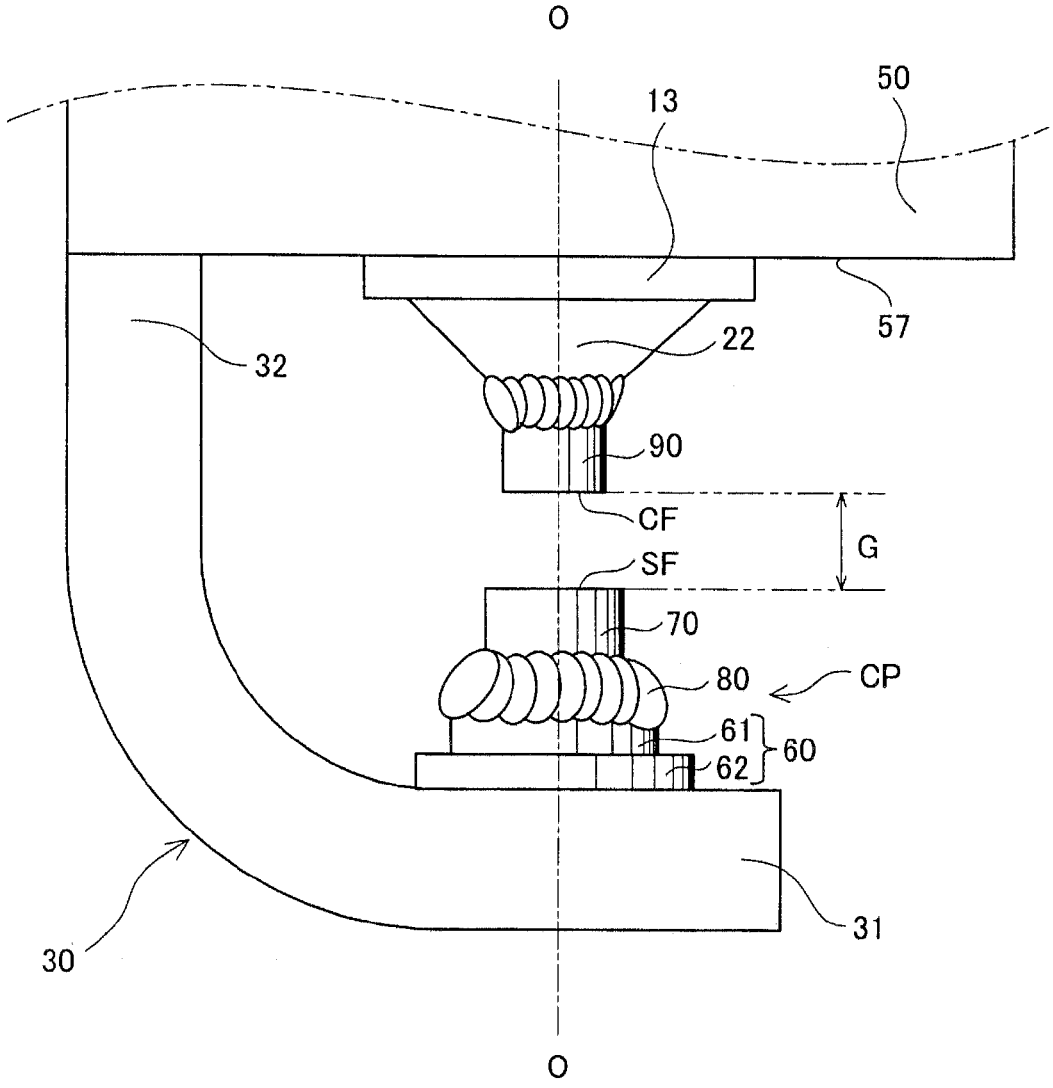
FIG. 4 is a enlarged view showing a forward end portion of a center electrode and its periphery.

FIG. 4 is an enlarged view showing a forward end portion of the center electrode 20 and its periphery. The composite tip CP is disposed where its axis is aligned with the axis of the center electrode 20. A spark gap G is formed between a bottom face CF of the center electrode 20 (herein, the bottom face of the noble metal tip 90) and the top face SF of the composite tip CP. In the example of FIGS. 1 to 4, the composite tip CP is provided at the distal end portion 31 of the ground electrode 30. However, the composite tip may be provided at a forward end portion of the center electrode 20. That is, preferably, the composite tip is provided at least one of the center electrode 20 and the ground electrode 30.

Figure 5A:
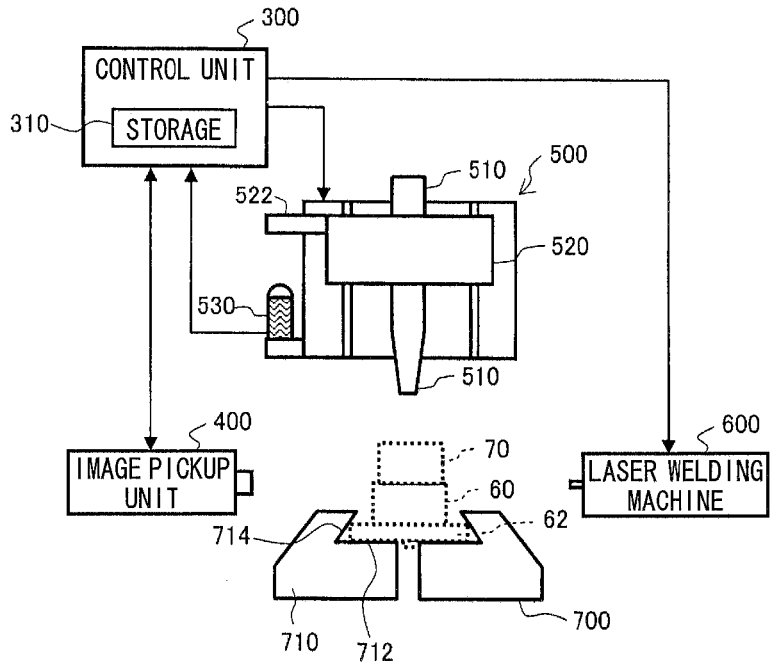
FIGS. 5A and 5B are explanatory views showing an example joining apparatus in a first embodiment of the present invention.
Figure 5B:
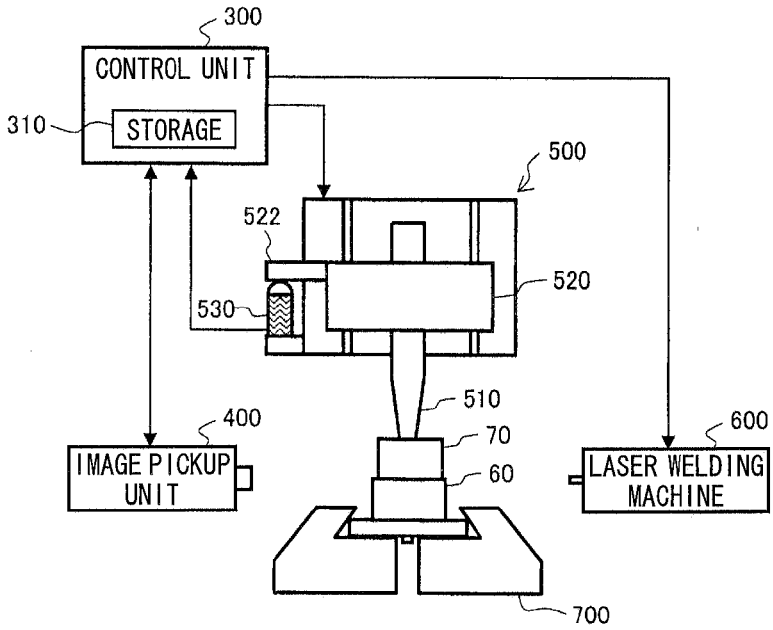

FIGS. 5A and 5B are explanatory views showing an example joining apparatus for forming the composite tip through joining of the two tips in the first embodiment. The joining apparatus includes a control unit 300 for controlling the entire joining apparatus; an image pickup unit 400; a tip-pressing unit 500; a laser welding machine 600; and a tip support 700. In the following description, the noble metal tip 70 is called the "first tip 70," and the intermediate tip 60 is called the "second tip 60."

The tip support 700 is adapted to support the second tip 60. The first tip 70 is placed on the second tip 60; however, in FIG. 5A, these tips 60 and 70 are drawn by a dashed line. The tip support 700 has a plurality of grippers 710, each having a placement surface 712 and a gripping claw 714. These grippers 710 are configured such that their gripping claws 714 can shift or pivotally move toward the center of the tip support 700. These grippers 710 grip the flange portion 62 of the second tip 60 from the radial outside, thereby supporting the second tip 60. In the gripped condition, the bottom face of the flange portion 62 rests on the placement surface 712 of the, and an upper edge of the flange portion 62 is pressed by the inner surfaces of the gripping claws 714. Since a plurality of (e.g., three) grippers 710 are provided around the second tip 60, the plurality of grippers 710 grip the second tip 60, whereby the center of the second tip 60 is properly positioned at the center position of the tip support 700. In order to enhance a positioning function which is carried out by the grippers 710, preferably, the placement surface 712 and the inner surface of the gripping claw 714 form an acute angle.

The tip-pressing unit 500 is adapted to press downward the top face of the first tip 70 in laser-welding the first tip 70 and the second tip 60 at their boundary. The tip-pressing unit 500 has a pressing jig 510 (also called the "pushing jig") for pressing the first tip 70; a drive mechanism 520 for vertically moving the pressing jig 510; and a length-measuring sensor 530. The drive mechanism 520 has a lever 522 for measuring length by pressing downward the length-measuring sensor 530. As shown in FIG. 5B, when the drive mechanism 520 lowers and presses the first tip 70, the lever 522 comes in contact with the length-measuring sensor 530 from above. When the length-measuring sensor 530 is pressed by the lever 522, the length-measuring sensor 530 varies in its height (length) and outputs to the control unit 300 the amount of variation in the form of a length measurement signal.

In a state in which while the second tip 60 and the first tip 70 are sequentially placed on the tip support 700, the tip-pressing unit 500 presses the first tip 70, the laser welding machine 600 welds the first tip 70 and the second tip 60 at their boundary to join them together, thereby forming the composite tip (FIG. 5B).

In laser welding, the height of the top face of the second tip 60 may vary from the height of the top face of the second tip 60 in a state immediately after the second tip 60 is supported on the tip support 700. That is, in a state in which the first tip 70 is placed on the second tip 60, when the first tip 70 is pressed from above by the tip-pressing unit 500, the height of the top face of the second tip 60 may slightly lower. This variation of height is caused, for example, by the following: when the second tip 60 is gripped by the grippers 710, the second tip 60 may come off the placement surface 712. Thus, as will be described later, the height of the top face of the second tip 60 is accurately measured for accurately determining the height of the top face of the second tip 60 (i.e., the height of the boundary between the first and second tips) in laser welding.

The image pickup unit 400 is used to measure the height of a tip. For example, in a state in which only the second tip 60 is placed on the tip support 700, the image pickup unit 400 captures an image of the second tip 60, and the control unit 300 analyzes the captured image (performs image processing), thereby measuring the height of the top face of the second tip 60. Various well-known methods can be utilized for this image analysis. For example, a multi-tone monochromatic image or a binary image is captured, and the edge of the image is detected, whereby the height of the top face of a tip can be determined.

The joining apparatus of FIGS. 5A and 5B uses two devices for measuring the height of a tip; namely, the image pickup unit 400 (the first measuring unit) and the length-measuring sensor 530 (the second measuring unit). As will be described later, the image pickup unit 400 is primarily used for measuring the height of the top face of the second tip 60 in a state in which only the second tip 60 is supported on the tip support 700 without the first tip 70 being placed on the second tip 60. On the other hand, the length-measuring sensor 530 is primarily used for measuring the height of the top face of the first tip 70 in a state in which while the second tip 60 is supported on the tip support 700, the first tip 70 is placed on the second tip 60. The image processing method can measure the height of the top face of a tip with considerably high accuracy. However, in the case where the two tips 60 and 70 have a very small difference in diameter (e.g., a difference of diameter of 0.1 mm or less), in a state in which the two tips 60 and 70 are overlaid on each other, difficulty may be encountered in accurately measuring the height of the boundary between the two tips 60 and 70 by image analysis. Thus, in the first embodiment, in a state in which the two tips 60 and 70 are overlaid on each other, instead of the image pickup unit 400, the length-measuring sensor 530 is used for measuring the height. A specific method of using these measuring units is described in detail below.

FIGS. 6A to 6D are explanatory views showing a preparation process for forming the composite tip through joining of the two tips. The process shown in FIGS. 6A to 6D is for obtaining two reference heights H1ref and H2ref and a reference height difference ΔH1ref. The first reference height H1ref (FIG. 6D) is a standard height of the top face of the first tip 70 in laser welding. The second reference height H2ref (FIG. 6B) is a standard height of the top face of the second tip 60 in a state in which the second tip 60 is placed on the tip support 700. The reference height difference ΔH1ref (FIG. 6D) is the amount of variation from the second reference height H2ref to the first reference height H1ref. Preferably, before manufacture of composite tips for products (spark plugs), the process shown in FIGS. 6A to 6D is carried out a plurality of times by use of standard tips 60 and 70.

Figure 6A:
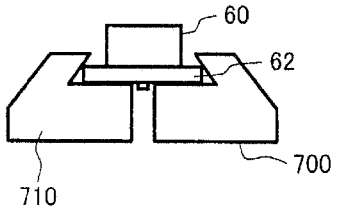
FIGS. 6A to 6D are explanatory views showing a preparation process in the first embodiment.
Figure 6B:
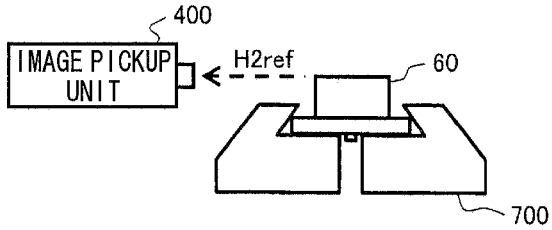
Figure 6C:
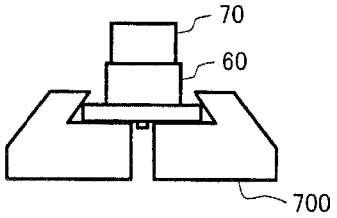
Figure 6D:
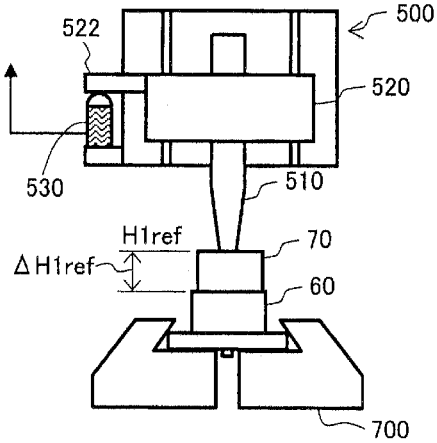

FIG. 6A shows a state in which the second tip 60 is placed on the grippers 710 of the tip support 700. Usually, the second tip 60 and the first tip 70 are automatically placed by respective carriers (not shown). In the step of FIG. 6B, the image pickup unit 400 captures an image of the second tip 60, and a top-face height H2 of the second tip 60 is measured by image processing. The average of the top-face heights H2 obtained by a plurality of measuring operations of FIG. 6B is stored, as the reference top-face height H2ref of the second tip 60, in a storage 310 (FIGS. 5A and 5B) of the control unit 300. In the step of FIG. 6C, the first tip 70 is placed on the second tip 60. In the step of FIG. 6D, the tip-pressing unit 500 presses the first tip 70 and the second tip 60 from the top face of the first tip 70; i.e., a top pressing operation (also called the "top-face pressing operation") is performed. While the top pressing operation is performed, a measured length H1 is obtained by use of the length-measuring sensor 530. The average of the measured lengths H1 obtained by a plurality of measuring operations of FIG. 6D is stored in the storage 310 as a reference top-face height H1ref of the first tip 70.

The reference height difference ΔH1ref is calculated by the following equation.

$$\Delta H1\text{ref}=H1\text{ref}-H2\text{ref} \quad (1)$$

Figure 7A:
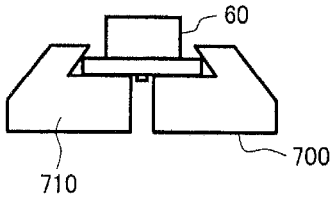
FIGS. 7A to 7E are explanatory views showing a joining process for forming a composite tip in the first embodiment.
Figure 7B:
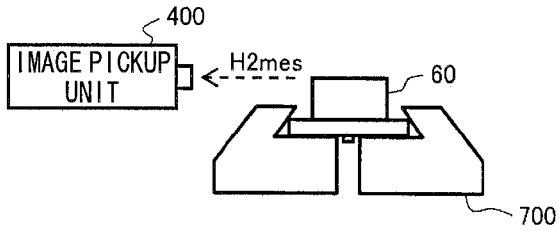

FIGS. 7A to 7E are explanatory views showing a joining process for forming composite tips for products. The process shown in FIGS. 7A to 7D is the same as that shown in FIGS. 6A to 6D. Specifically, in the step of FIG. 7A, the second tip 60 is placed on the grippers 710. In the step of FIG. 7B, the top-face height H2mes of the second tip 60 is measured by image processing. Then, in the step of FIG. 7C, the first tip 70 is placed on the second tip 60. Subsequently, in the step of FIG. 7D, while the top pressing operation is performed, a measured length H1mes is obtained by use of the length-measuring sensor 530. The measured length H1mes corresponds to a measured top-face height of the first tip 70.

Through the measuring operations shown in FIGS. 6A to 6D and FIGS. 7A to 7D, the following reference values and measured values are obtained.

H1ref: reference top-face height of the first tip 70 (FIG. 6D)

H2ref: reference top-face height of the second tip 60 (FIG. 6B)

Figure 7C:
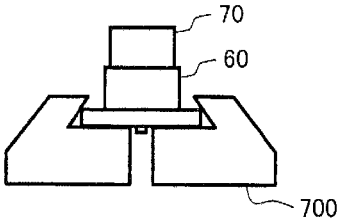
Figure 7D:
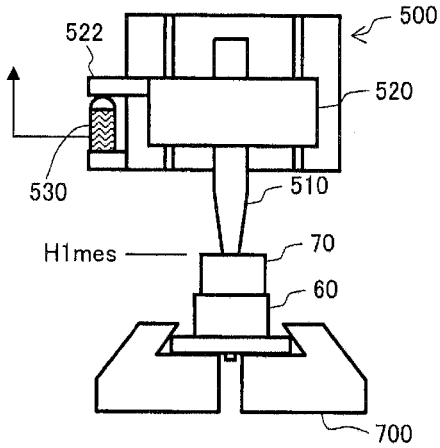

H1mes: measured top-face height of the first tip 70 (FIG. 7D)

H2mes: measured top-face height of the second tip 60 (FIG. 7B)

ΔH1ref: reference height difference (Eq. (1) above)

These reference values and measured values (height information) are stored in the storage 310 of the control unit 300.

By use of these values, the control unit 300 can calculate the following indices.

(i) First Abnormality Index δ1

$$\delta 1=(H2\text{mes}+\Delta H1\text{ref})-H1\text{mes} \quad (2)$$

The first term "(H2mes+ΔH1ref)" on the right side of Eq. (2) corresponds to a probable top-face height of the first tip 70 in the state of FIG. 7C. The second term "H1mes" on the right side of Eq. (2) is a measured top-face height of the first tip 70 as measured after top pressing (FIG. 7D). Therefore, when the abnormality index δ1 is excessively large, this implies that the second tip 60 is off the placement surface 712 in the states of FIGS. 7A to 7C or that an apparatus error associated with temperature variations is large. Also, even when the abnormality index δ1 is excessively small, there is the possibility of the occurrence of a certain abnormality in measurement. Thus, when the first abnormality index δ1 falls outside a predetermined first tolerance, a certain abnormality can be judged to exist. The first tolerance is predetermined experimentally or empirically. This also applies to other tolerances appearing in the following description.

(ii) Second Abnormality Index δ2

$$\delta 2=H1\text{ref}-H1\text{mes} \quad (3)$$

The second abnormality index δ2 is the difference between the reference top-face height of the first tip 70 and an actually measured top-face height of the first tip 70 as measured after top pressing. When the abnormality index δ2 falls outside the second tolerance, there is also the possibility of the occurrence of a certain fault.

(iii) Third Abnormality Index δ3

$$\delta 3=H2\text{mes}-H1\text{mes} \quad (4)$$

The third abnormality index δ3 is the difference between the measured top-face height H2mes of the second tip 60 and the measured top-face height H1mes of the first tip 70. Therefore, when the abnormality index δ3 falls outside the third tolerance, there is also the possibility of the occurrence of a certain fault.

When the control unit 300 judges from the above-mentioned three abnormality indices δ1 to δ3 that a certain abnormality has occurred, preferably, welding to form the composite tip is cancelled or retried (the operation starts from the step of FIG. 7A). These abnormality determination operations may be eliminated partially or entirely.

When laser welding is to be performed, the control unit 300 calculates a height correction value ΔH2 for correcting a laser welding height (the height of the top face of the second tip 60) as follows.

$$\Delta H2a=(H2\text{ref}-H2\text{mes})-(H1\text{ref}-H1\text{mes}) \quad (5)$$

The first term on the right side is the difference between the reference top-face height H2ref of the second tip 60 and the measured top-face height H2mes of the second tip 60, and the second term on the right side is the difference between the reference top-face height H1ref of the first tip 70 and the measured top-face height H1mes of the first tip 70. For example, when, in a state in which the second tip 60 is supported on the tip support 700 (FIG. 7B), the second tip 60 is in contact with the placement surface 712, the first term and the second term on the right side offset each other; thus, the height correction value ΔH2*a* becomes substantially zero. On the other hand, when the second tip 60 is off the placement surface 712, the measured top-face height H1mes of the first tip 70 reduces accordingly; thus, the absolute value of the second term on the right side of Eq. (5) increases, and the height correction value ΔH2*a* becomes a negative value. In this manner, the height correction value ΔH2*a* can be considered to be indicative of to what extent the second tip 60 is off the placement surface 712.

The control unit 300 can calculate a corrected top-face height H2cor of the second tip 60 by use of the height correction value ΔH2*a*.

$$H2\text{cor}=H2\text{mes}+\Delta H2a \quad (6)$$

Figure 7E:
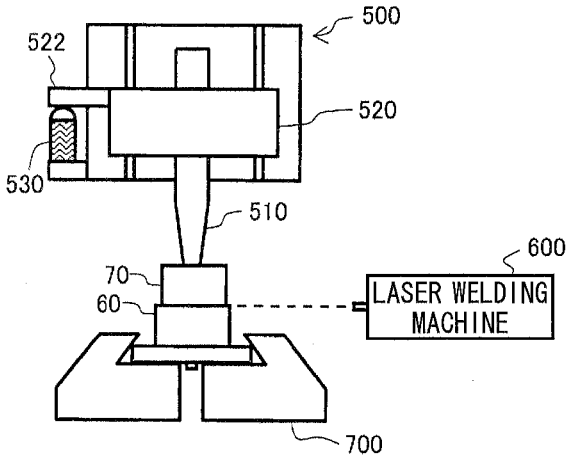

The corrected top-face height H2cor indicates the height of the boundary plane between the first tip 70 and the second tip 60. Therefore, by means of the laser welding height of the laser welding machine 600 being adjusted by use of the corrected height H2cor, the first tip 70 and the second tip 60 can be properly welded together at the boundary therebetween as shown in FIG. 3. FIG. 7E shows a state in which welding is performed in this manner.

For use in the subsequent step of welding for forming the composite tip, the measured values H2mes and H1mes obtained in the steps shown in FIGS. 7B and 7D, respectively, may be reflected in the respective reference values H2ref and H1ref. For example, the number of times of measurement for obtaining the reference value H2ref is stored in the storage 310, and the average of all measured values including the newly measured value H2mes is calculated, whereby the reference value H2ref can be updated. This also applies to the reference value H1ref.

As mentioned above, in the first embodiment, the top-surface height of the second tip 60 is measured (FIG. 7B); in a state in which the first tip 70 is placed on the second tip 60, the top face of the first tip 70 is pressed downward, and then the top-face height of the first tip 70 is measured (FIG. 7D); and the top-face height of the second tip 60 is corrected by use of these measured values. Therefore, even in the case where the second tip 60 comes off the placement surface 712, a proper height for laser welding can be obtained. As a result, laser welding can be performed at the proper height. Also, the reference values H2ref and H1ref are determined from measured values obtained by a plurality of times of measurement, and, by use of the thus-determined reference values H2ref and H1ref, the height correction value ΔH2*a* is obtained. Therefore, even when measured heights somewhat vary according to temperature variation of the apparatus or the like, the variation can be reflected in correction to be made.

By substituting Eq. (6) into Eq. (5), the following equation is obtained.

$$H2\text{cor}=H2\text{ref}-(H1\text{ref}-H1\text{mes}) \quad (7)$$

In this case, as will be understood, the second term "(H1ref−H1mes)" on the right side of Eq. (7) is used as a height correction value.

In the case where the corrected top-face height H2cor of the second tip 60 is calculated according to Eq. (7), the step of FIG. 7B of measuring height can be eliminated. However, preferably, the step of FIG. 7B of measuring height is performed for the following reason. Through execution of the step of FIG. 7B of measuring height, the above-mentioned abnormality determination operations which use the first abnormality index δ1 and the third abnormality index δ3 can be carried out, whereby the tips can be welded in a reliably abnormality-free condition.

B. Second Embodiment

FIGS. 8A to 8E are explanatory views showing a joining apparatus and operations of the joining apparatus in a second embodiment of the present invention, and correspond to FIGS. 7A to 7E for the first embodiment. In the second embodiment, the preparation process described with reference to FIGS. 6A to 6D may be eliminated.

Figure 8A:
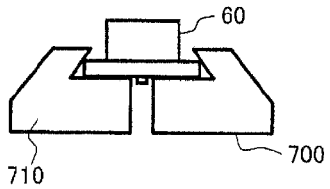
FIGS. 8A to 8E are explanatory views showing a joining process for forming a composite tip in a second embodiment of the present invention.
Figure 8B:
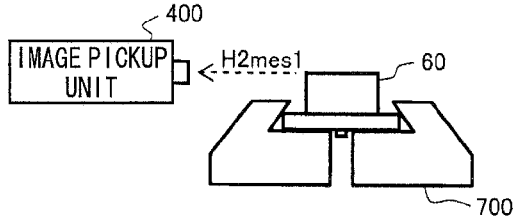
Figure 8C:
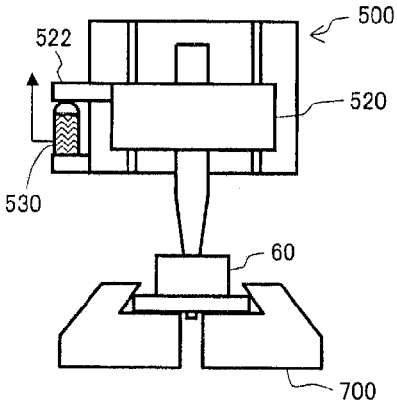

FIGS. 8A and 8B are identical with FIGS. 7A and 7B, respectively, and the top-face height H2 of the second tip 60 is measured by image processing. However, in the second embodiment, the top-face height of the second tip 60 is also measured in the step of FIG. 8D, which will be described later; therefore, a height measured in the step of FIG. 8B is denoted by "H2mes1." The step of FIG. 8C performs a top pressing operation of pressing downward the second tip 60 from the top face of the second tip 60 by use of the tip-pressing unit 500. In the step of FIG. 8C, the top pressing operation is performed without the first tip 70 being placed on the second tip 60. Subsequently, in the step of FIG. 8D, similar to the step of FIG. 8B, a top-face height H2mes2 of the second tip 60 is remeasured by image processing. In the case where, in the state of FIG. 8B, the second tip 60 is off the placement surface 712, the measured value H2mes2 obtained in the step of FIG. 8D differs greatly from the measured value H2mes1 obtained in the step of FIG. 8B.

In the second embodiment, a height correction value ΔH2*b* and a corrected top-face height H2cor of the second tip 60 are calculated by the following equations.

$$\Delta H2b=(H2\text{mes}2-H2\text{mes}1) \quad (8)$$

$$H2\text{cor}=\text{H2mes}1+\Delta H2b \quad (9)$$

As mentioned above, in the second embodiment, the top-face height of the second tip 60 is measured; after the top face of the second tip 60 is pressed downward, the top-face height of the second tip 60 is remeasured; and by use of these measured values, the top-face height of the second tip 60 is corrected. Therefore, even when the second tip 60 is off the placement surface 712, a proper height for laser welding can be obtained. As a result, laser welding can be performed at the proper height.

By substituting Eq. (8) into Eq. (9), the following equation is obtained.

$$H2\text{cor}=H2\text{mes}2 \quad (10)$$

In use of Eq. (10), the second measured value H2mes2 is used as a corrected height. However, even in this case, the height correction value ΔH2*b* obtained by Eq. (8) can be considered to be essentially used. This also applied to a third embodiment of the present invention to be described below.

C. Third Embodiment

FIGS. 9A to 9E are explanatory views showing a joining apparatus and operations of the joining apparatus in a third embodiment of the present invention, and correspond to FIGS. 7A to 7E for the first embodiment. In the third embodiment, the preparation process described with reference to FIGS. 6A to 6D may be eliminated.

Figure 9A:
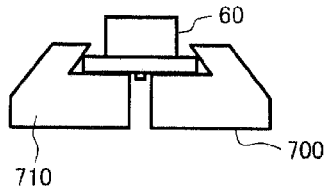
FIGS. 9A to 9E are explanatory views showing a joining process for forming a composite tip in a third embodiment of the present invention.
Figure 9B:
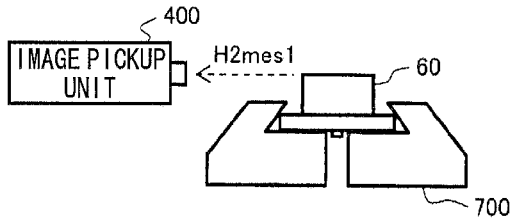
Figure 9C:
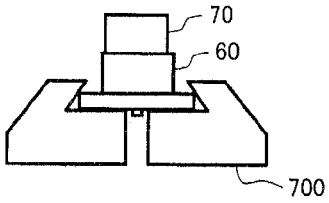
Figure 9D:
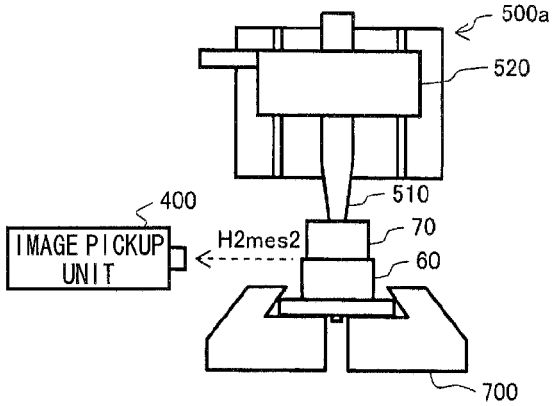
Figure 9E:
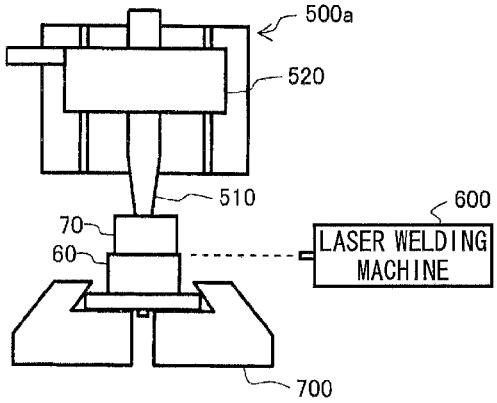

FIGS. 9A to 9C are identical with FIGS. 7A to 7C, respectively. Specifically, in the step of FIG. 93, the top-face height H2mes1 of the second tip 60 is measured by image processing, and in the step of FIG. 9C, the first tip 70 is placed on the second tip 2. In the step 9D, while, by use of the tip-pressing unit 500, the top pressing operation is performed; i.e., the first tip 70 is pressed downward from the top face of the first tip 70, the top-face height H2mes2 of the second tip 60 is remeasured by image processing by use of the image pickup unit 400. In the state of FIG. 9D, the first tip 70 is placed on the second tip 60; therefore, the image processing involves a search for the boundary between the first tip 70 and the second tip 60.

Also in the third embodiment, similar to the second embodiment, a height correction value ΔH2*c* and the corrected top-face height H2cor of the second tip 60 are calculated by the following equations.

$$\Delta H2c=(H2\text{mes}2-H2\text{mes}1) \quad (11)$$

$$H2\text{cor}=\text{H2mes}1+\Delta H2c \quad (12)$$

As mentioned above, in the third embodiment, the top-face height of the second tip 60 is measured; after the first tip 70 is placed on the second tip 60, the top face of the first tip 70 is pressed downward, and then the top-face height of the second tip 60 is remeasured; and by use of these measured values, the top-face height of the second tip 60 is corrected. Therefore, even when the second tip 60 is off the placement surface 712, a proper height for laser welding can be obtained. As a result, laser welding can be performed at the proper height.

Figure 8D:
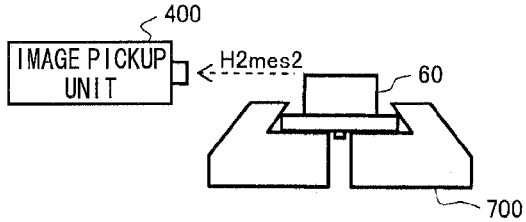
Figure 8E:
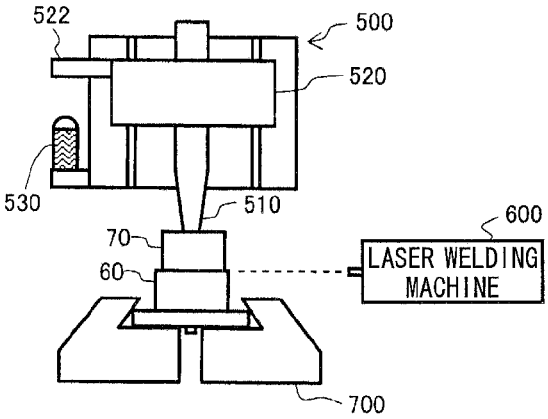

In the first embodiment (FIGS. 7A to 7E), in a state in which the first tip 70 is placed on the second tip 60, and the first tip 70 is pressed from above, the height of the first tip 70 is measured (FIG. 7D), thereby obtaining a height correction value. In the second embodiment (FIGS. 8A to 8E), after only the second tip 60 is pressed from above, the height of the second tip 60 is measured (FIG. 8D), thereby obtaining a height correction value. In the third embodiment (FIGS. 9A to 9E), in a state in which the first tip 70 is placed on the second tip 60, and the first tip 70 is pressed from above, the height of the second tip 60 is measured (FIG. 9D), thereby obtaining a height correction value. As is understood from these embodiments, preferably, at least the second tip 60 is pressed downward by use of the pressing jig before measurement for obtaining a correction value used to correct a laser-beam radiation height (FIGS. 7D, 8D, and 9D). Also, in the case where measurement for obtaining a correction value for correcting the laser-beam radiation height is performed in a state in which the first tip 70 placed on the second tip 60 is pressed from above, the first tip 70 placed on the second tip 60, the height correction value can be obtained with higher accuracy.

D. Spark Plug Manufacturing Process

Figure 10:
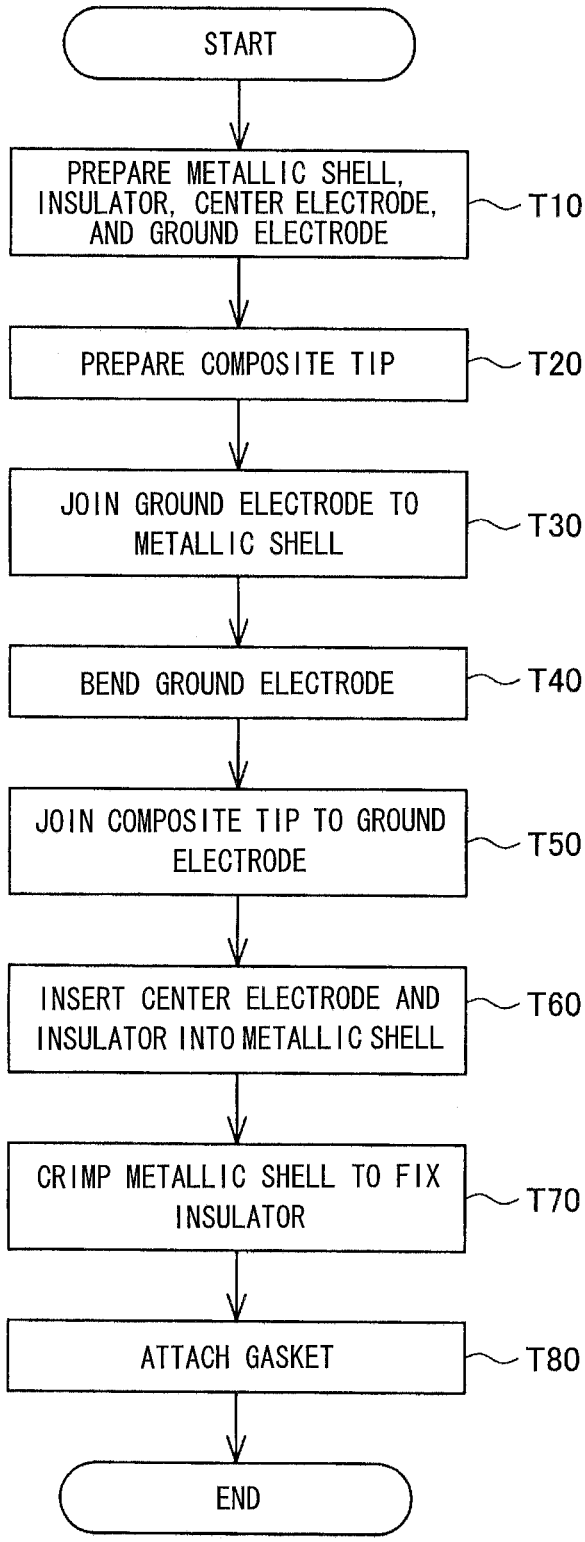
FIG. 10 is a flowchart showing a process for manufacturing a spark plug.

FIG. 10 is a flowchart showing a process for manufacturing a spark plug according to an embodiment of the present invention, Step T10 prepares the metallic shell 50, the insulator 10, the center electrode 20, and the ground electrode 30. Step T20 prepares the composite tip CP by joining the first tip 70 and the second tip 60 together. The composite tip CP is prepared by any one of the procedures described above with reference to FIGS. 7A to 7E, 8A to 8E, and 9A to 9E. Step T30 joins the ground electrode 30 to the metallic shell 50. Step T40 bends a distal end portion of the ground electrode 30 by use of a bending device (not illustrated). Step T50 joins the composite tip CP to the distal end portion 31 of the ground electrode 30 (FIG. 4). This joining operation is performed by, for example, resistance welding. Step T60 inserts the center electrode 20 and the insulator 10 into the metallic shell 50 for their assembly. This assembling step forms an assembly in which the insulator 10 and the center electrode 20 are assembled into the metallic shell 50. This assembling step may employ either one of the following two methods: a method in which an assembly of the center electrode 20 and the insulator 10 is assembled into the metallic shell 50 and a method in which the center electrode 20 is assembled to an assembly of the insulator 10 and the metallic shell 50. Step T70 performs crimping on the metallic shell 50 by use of a crimping tool (not shown). This crimping operation fixes the insulator 10 to the metallic shell 50. Step T80 attaches the gasket 5 to the mounting threaded portion 52 of the metallic shell 50, thereby completing the spark plug 100.

The manufacturing method shown in FIG. 10 is a mere example. The spark plug can be manufactured by various other methods. For example, the sequence of the steps T10 to T80 can be modified as appropriate.

MODIFIED EMBODIMENTS

The present invention is not limited to the above-described embodiments or modes, but may be embodied in various other forms without departing from the gist of the invention. For example, the following modifications are possible.

Modified Embodiment 1

The above-described embodiments use the image pickup unit 400 (the first measuring unit) and the length-measuring sensor 530 (the second measuring unit) to measure the top-face heights of the tips. However, various other types of measuring units can be used. However, preferably, the first and second measuring units of different measuring principles are used. This is for the reason that measurement can be performed under measuring conditions suited for respective measuring principles and measuring unit configurations. The length-measuring sensor is not limited to a contact-type sensor. The length-measuring sensor can be of different types of measuring principles, such as a laser type, an LED type, an ultrasonic type, and an overcurrent type. Notably, the length-measuring sensor has the advantage that, through use in a state in which the first tip 70 is placed on the second tip 60, measurement can be performed more easily than measurement by image processing.

DESCRIPTION OF REFERENCE NUMERALS

3: ceramic resistor
4: seal body
5: gasket
6: ring member
7: ring member
8: sheet packing
9: talc
10: insulator
12: axial bore
13: leg portion
15: stepped portion
17: forward trunk portion
18: rear trunk portion
19: flange portion
20: center electrode
21: electrode base metal
22: forward end portion
25: core
30: ground electrode
31: distal end portion
32: proximal portion
40: metal terminal
50: metallic shell
51: tool engagement portion
52: mounting threaded portion
53: crimp portion
54: seal portion
55: seat surface
56: stepped portion
57: forward end surface
58: buckle portion
59: screw neck
60: intermediate tip (second tip)
61: columnar portion
62: flange portion
70: noble metal tip (first tip)
71: edge
80: fusion zone
90: noble metal tip
100: spark plug
200: engine head
201: mounting threaded hole
205: peripheral-portion-around-opening
300: control unit
310: storage
400: image pickup unit
500: tip-pressing unit
510: pressing jig
520: drive mechanism
522: lever
530: length-measuring sensor
600: laser welding machine
700: tip support
710: gripper
712: placement surface
714: gripping claw

We claim:

1. A method of manufacturing a spark plug which comprises:

a center electrode;

an insulator disposed externally of an outer circumference of the center electrode;

a metallic shell disposed externally of an outer circumference of the insulator; and a ground electrode joined at one end portion to the metallic shell and disposed such that another end portion faces the center electrode;

at least one of the center electrode and the ground electrode having a composite tip, the composite tip being configured such that a first tip and a second tip are joined together, the first tip forming a gap in cooperation with the center electrode or the ground electrode, the second tip connecting the first tip to the center electrode or the ground electrode; and the method comprising a joining process for joining the first tip and the second tip together by use of a laser beam, wherein the joining process comprises the steps of:

(a) disposing the second tip on a support;

(b) obtaining, after pressing downward at least the second tip by use of a pressing jig, a correction value for correcting a height of radiation of the laser beam;

(c) correcting the height of radiation of the laser beam on the basis of the correction value; and (d) joining the first and second tips together by use of the laser beam.

2. The method of manufacturing a spark plug according to claim 1, wherein:

the joining process further comprises a step (I) of obtaining information representing a top-face height of the second tip supported on the support by use of a first measuring unit, said step (i) being performed before the step (b) and the step (b) further comprises the sub-steps of:

disposing the first tip on the second tip;

pressing downward a top face of the first tip by use of the pressing jig;

obtaining, after the first-tip top pressing step, information representing a top-face height of the first tip by use of a second measuring unit; and obtaining the correction value by use of the obtained information representing the top-face height of the first tip, the information representing the top-face height of the second tip obtained in the step (i), and a predetermined reference top-face height.

3. The method of manufacturing a spark plug according to claim 2, wherein:

the first measuring unit captures an image of the second tip and analyzes the image to obtain the information representing the top-face height of the second tip, and the second measuring unit obtains the information representing the top-face height of the first tip according to a measuring principle different from that of the first measuring unit.

4. The method of manufacturing a spark plug according to claim 3, wherein the second measuring unit is a length-measuring sensor.

5. The method of manufacturing a spark plug according to claim 1, wherein:

the joining process further comprises a step (i) of obtaining information representing a top-face height of the second tip supported on the support by use of a first measuring unit, said step (i) being performed before the step (b); and the step (b) further comprises the sub-steps of:

reobtaining, after pressing downward the second tip by use of the pressing jig, information representing a top-face height of the second tip by use of the first measuring unit, and obtaining the correction value by use of the reobtained information representing the top-face height information of the second tip and the information representing the top-face height of the second tip obtained in the step (i); and wherein the joining process further comprises a step of disposing the first tip on the second tip before the step (d) of joining the first and second tips together.

* * * * *